US012091791B2

(12) United States Patent
Yoon et al.

(10) Patent No.: US 12,091,791 B2
(45) Date of Patent: Sep. 17, 2024

(54) NONWOVEN FABRIC WITH IMPROVED MECHANICAL STRENGTH

(71) Applicant: Toray Advanced Materials Korea Inc., Gyeongsangbuk-do (KR)

(72) Inventors: Do Kyung Yoon, Gyeongsangbuk-do (KR); Seo Jin Park, Gyeongsangbuk-do (KR)

(73) Assignee: Toray Advanced Materials Korea Inc., Gyeongsangbuk-do (KR)

( * ) Notice: Subject to any disclaimer, the term of this patent is extended or adjusted under 35 U.S.C. 154(b) by 0 days.

(21) Appl. No.: 17/788,040

(22) PCT Filed: Dec. 24, 2020

(86) PCT No.: PCT/KR2020/019122
§ 371 (c)(1),
(2) Date: Jun. 22, 2022

(87) PCT Pub. No.: WO2021/133110
PCT Pub. Date: Jul. 1, 2021

(65) Prior Publication Data

US 2023/0039949 A1 Feb. 9, 2023

(30) Foreign Application Priority Data

Dec. 24, 2019 (KR) ..... 10-2019-0174092

(51) Int. Cl.
*D04H 1/4291* (2012.01)
*D04H 3/007* (2012.01)
*D04H 3/14* (2012.01)
*D04H 13/00* (2006.01)

(52) U.S. Cl.
CPC ..... *D04H 1/4291* (2013.01); *D04H 3/007* (2013.01); *D04H 3/14* (2013.01); *D04H 13/00* (2013.01); *D10B 2321/022* (2013.01); *D10B 2401/063* (2013.01); *D10B 2509/00* (2013.01)

(58) Field of Classification Search
CPC ..... D04H 1/4291; D04H 3/007; D04H 3/14; D04H 13/00; D10B 2321/022; D10B 2401/063; D10B 2509/00
See application file for complete search history.

(56) References Cited

U.S. PATENT DOCUMENTS

| | | | | |
|---|---|---|---|---|
| 5,733,646 | A | 3/1998 | Gupta et al. | |
| 6,270,892 | B1 | 8/2001 | Park et al. | |
| 7,138,058 | B2 | 11/2006 | Kurth et al. | |
| 11,306,415 | B2 | 4/2022 | Ferry et al. | |
| 2001/0031814 | A1* | 10/2001 | Park | D01F 6/06 264/210.8 |
| 2006/0057373 | A1 | 6/2006 | Inagaki et al. | |
| 2008/0038982 | A1* | 2/2008 | Motomura | B32B 5/26 156/160 |
| 2008/0185332 | A1 | 8/2008 | Niu et al. | |
| 2009/0111347 | A1* | 4/2009 | Peng | D01F 6/46 264/211 |
| 2011/0253152 | A1 | 10/2011 | Lin et al. | |
| 2017/0304481 | A1 | 10/2017 | Kupelian et al. | |
| 2021/0291119 | A1 | 9/2021 | Lee et al. | |
| 2021/0322927 | A1 | 10/2021 | Cho et al. | |
| 2022/0011630 | A1 | 1/2022 | Ko et al. | |

FOREIGN PATENT DOCUMENTS

| | | |
|---|---|---|
| EP | 1275763 | 1/2003 |
| EP | 1413593 | 4/2004 |
| EP | 4187003 | 5/2023 |
| EP | 4230777 | 8/2023 |
| JP | 2001-020132 | 1/2001 |
| JP | 2004-232172 | 8/2004 |
| JP | 2004-323990 | 11/2004 |
| JP | 2006-274506 | 10/2006 |
| JP | 2007-167783 | 7/2007 |
| JP | 2009-538394 | 11/2009 |
| JP | 2010-126614 | 6/2010 |
| JP | 2011-012200 | 1/2011 |
| JP | 2012-017543 | 1/2012 |
| JP | 2012-092475 | 5/2012 |
| JP | 2016-151000 | 8/2016 |
| JP | 2017-000939 | 1/2017 |
| KR | 10-0340277 | 1/2001 |
| KR | 10-0401248 | 11/2001 |
| KR | 10-2002-0001307 | 1/2002 |
| KR | 10-2004-0022101 | 3/2004 |
| KR | 10-2008-0032604 | 4/2008 |
| KR | 10-2009-0014302 | 2/2009 |
| KR | 10-2010-0008213 | 1/2010 |
| KR | 10-2011-0109387 | 10/2011 |

(Continued)

OTHER PUBLICATIONS

U.S. Appl. No. 17/761,146, filed Mar. 16, 2022, by Lee et al. (copy not provided) (Copy not submitted herewith pursuant to the waiver of 37 C.F. R. § 1.98(a)(2)(iii) issued by the Office on Sep. 21, 2004).
U.S. Appl. No. 17/761,564, filed Mar. 17, 2022, by Lee et al. (copy not provided) (Copy not submitted herewith pursuant to the waiver of 37 C.F. R. § 1.98(a)(2)(iii) issued by the Office on Sep. 21, 2004).
U.S. Appl. No. 17/772,997, filed Apr. 28, 2022, by Park et al. (copy not provided) (Copy not submitted herewith pursuant to the waiver of 37 C.F. R. § 1.98(a)(2)(iii) issued by the Office on Sep. 21, 2004).
Office Action for Indian Application No. 202247031959 dated Sep. 5, 2022, 5 pages.
U.S. Appl. No. 18/017,600, filed Jan. 23, 2023, by Lim (copy not provided) (Copy not submitted herewith pursuant to the waiver of 37 C.F. R. § 1.98(a)(2)(iii) issued by the Office on Sep. 21, 2004).
U.S. Appl. No. 18/032,547, filed Apr. 18, 2023, by Lee et al. (copy not provided) (Copy not submitted herewith pursuant to the waiver of 37 C.F. R. § 1.98(a)(2)(iii) issued by the Office on Sep. 21, 2004).

*Primary Examiner* — Jeremy R Pierce
(74) *Attorney, Agent, or Firm* — Morrison & Foerster LLP

(57) ABSTRACT

The present invention relates to a non-woven fabric with improved mechanical strength, and more particularly, to a non-woven fabric exhibiting excellent spinnability, excellent softness, and excellent tensile strength while enabling a weight reduction.

8 Claims, No Drawings

(56) References Cited

FOREIGN PATENT DOCUMENTS

| | | |
|---|---|---|
| KR | 10-2013-0000477 | 1/2013 |
| KR | 10-2015-0079146 | 7/2015 |
| KR | 10-2015-0083048 | 7/2015 |
| KR | 10-1541654 | 8/2015 |
| KR | 10-2016-0079347 | 7/2016 |
| KR | 10-2017-0004170 | 1/2017 |
| KR | 10-2017-0015717 | 2/2017 |
| KR | 10-2021-0084091 | 7/2021 |
| WO | WO 2001/034884 | 5/2001 |
| WO | WO 2001/073174 | 10/2001 |
| WO | WO 2005/080497 | 9/2005 |
| WO | WO 2006/044083 | 4/2006 |
| WO | WO 2006/118794 | 11/2006 |
| WO | WO 2007/140163 | 12/2007 |
| WO | WO 2015/136389 | 9/2015 |

* cited by examiner

NONWOVEN FABRIC WITH IMPROVED MECHANICAL STRENGTH

CROSS REFERENCE TO RELATED APPLICATIONS

This application is a national stage application under 35 U.S.C. § 371 of International Application No. PCT/KR2020/019122, filed internationally on Dec. 24, 2020, which claims priority to and the benefit of Korean Patent Application No. 10-2019-0174092, filed on Dec. 24, 2019, the disclosures of which are incorporated herein by reference in their entirety.

BACKGROUND

1. Field of the Invention

The present invention relates to a non-woven fabric with improved mechanical strength, and more particularly, to a non-woven fabric with improved mechanical strength, which is excellent in spinnability, excellent in softness, capable of having its weight reduced, and excellent in tensile strength.

2. Discussion of Related Art

Conventional non-woven fabrics are used in a wide range of fields, such as absorbent articles such as disposable diapers and sanitary napkins, cleaning products such as wipes, and medical products such as masks. As described above, the non-woven fabric is used in various other fields, but when it is actually used for products in each field, it is necessary to manufacture so as to have properties or structures suitable for the use of each product.

Diaper usage has increased in recent years along with the population growth in emerging countries centered on China, and a huge market is expected. Meanwhile, an increase in $CO_2$ emission accompanying an increase in the usage of disposable paper diapers has become a serious environmental problem. Plant-derived raw materials have been studied in terms of reducing the global increase in CO2 emission, but they have not been realized in terms of quality, cost, and productivity. Meanwhile, although a paper diaper manufacturer has investigated $CO_2$ emission reduction by the weight reduction of a non-woven fabric and packaging, it is not enough.

Meanwhile, in the case of a non-woven fabric used as an absorbent article such as a disposable diaper or a sanitary napkin, there is a need for suitable physical and tactile properties, clean hygienic properties, and the like, as well as having easy supply for general use and processability suitable for product production.

However, in the case of the conventional non-woven fabric, there has been a disadvantage that it is impossible to commercialize a non-woven web because it has a sticky and uncomfortable feel that makes it undesirable for skin contact applications, and as the weight of the non-woven web is reduced to 100 gsm or less that is required for application to disposable diapers, the shape of the non-woven web becomes very unstable.

In addition, there were problems in that the spinnability of the polymer forming the non-woven fabric was not good, softness was lowered, and a weight reduction and excellent tensile strength could not be expressed at the same time.

Accordingly, there is an urgent need to research a non-woven fabric that exhibits effects of excellent spinnability, excellent softness, and excellent tensile strength while enabling a weight reduction.

SUMMARY OF THE INVENTION

The present invention has been devised in view of the above points, and an object of the present invention is to provide a non-woven fabric which is excellent in spinnability, excellent in softness, capable of having its weight reduced, and excellent in tensile strength.

In order to solve the above problems, the present invention provides a non-woven fabric with improved mechanical strength, which is formed through fibers including a polypropylene homopolymer and satisfies both the following conditions (1) and (2).

$$b/a \leq 0.3 \quad (1)$$

$$(a^{1/2}+b)^{1/2} \leq 3.6 \quad (2)$$

wherein, a is the melt index (g/10 min) of the polypropylene homopolymer, and b is the polydispersity index (Mw/Mn, weight average molecular weight/number average molecular weight) of the polypropylene homopolymer.

According to an embodiment of the present invention, both of the following conditions (1) and (2) may be satisfied.

$$b/a \leq 0.23 \quad (1)$$

$$(a^{1/2}+b)^{1/2} \leq 3.33 \quad (2)$$

In addition, the polypropylene homopolymer may have a melt index of 13 to 70 g/10 min.

In addition, the polypropylene homopolymer may have a polydispersity index of 3.2 or less.

In addition, the following condition (3) may be further satisfied.

$$\text{tensile strength in MD direction per unit weight/ tensile strength in CD direction per unit weight is} \leq 4. \quad (3)$$

In addition, the tensile strength in the MD direction per unit weight may be 0.19 $kg_f$/5 cm/gsm or more.

In addition, the tensile strength in the CD direction per unit weight may be 0.05 to 2.0 $kg_f$/5 cm/gsm or more.

In addition, the fibers may be formed to further include a feel-improving agent.

In addition, 0.1 to 25 parts by weight of the feel-improving agent may be further included, based on 100 parts by weight of the polypropylene homopolymer.

In addition, the feel-improving agent may include one or more selected from a slip agent and a fabric softener including one or more selected from the group consisting of propylene-ethylene copolymers and $C_4$-$C_{12}$ alpha-olefin copolymers.

In addition, the propylene-ethylene copolymer and the $C_4$-$C_{12}$ alpha-olefin copolymer may each independently have a melt index of 550 g/10 min or less.

In addition, the propylene-ethylene copolymer may include an ethylene monomer and a propylene monomer in a molar ratio of 1:0.8 to 0.95.

In addition, the non-woven fabric may have a basis weight of 8 to 50 g/$m^2$.

Meanwhile, the present invention provides a sanitary material formed including the above-described non-woven fabric.

Effects of the Invention

The non-woven fabric with improved mechanical strength according to the present invention exhibits excellent spinnability, excellent softness, and excellent tensile strength while enabling a weight reduction.

DETAILED DESCRIPTION OF EXEMPLARY EMBODIMENTS

Hereinafter, embodiments of the present invention will be described in detail so as to be easily carried out by those skilled in the art. The present invention may be embodied in many different forms and is not limited to the embodiments set forth herein.

The non-woven fabric with improved mechanical strength according to the present invention is formed through fibers formed including a polypropylene homopolymer.

Before describing the non-woven fabric with improved mechanical strength according to the present invention, the reason why the non-woven fabric with improved mechanical strength according to the present invention must satisfy the following conditions (1) and (2) will be first described.

When the melt index of the polymer forming the non-woven fabric is low, as the length of the polymer chain becomes longer, spinnability may significantly decrease due to high viscosity, and when the melt index is high, mechanical properties may decrease as the length of the polymer chain becomes shorter. In addition, when the polydispersity index of the polymer is high, fiber breakage may occur or the uniformity of the manufactured non-woven fabric may be reduced, so that mechanical properties may be lowered.

Accordingly, the non-woven fabric with improved mechanical strength according to the present invention satisfies the following conditions (1) and (2).

As condition (1), $b/a \leq 0.3$, preferably $b/a \leq 0.23$, and more preferably $0.08 \leq b/a \leq 0.12$.

Further, as condition (2), $(a^{1/2}+b)^{1/2} \leq 3.6$, preferably $(a^{1/2}+b)^{1/2} \leq 3.33$, more preferably $2.00 \leq (a^{1/2}+b)^{1/2} \leq 2.90$.

When b/a exceeds 0.3 in the above condition (1), spinnability, softness and mechanical properties may be lowered, and in the above condition (2), when $(a^{1/2}+b)^{1/2}$ exceeds 3.6, mechanical properties may be lowered.

Hereinafter, the polypropylene homopolymer used for preparing the non-woven fabric with improved mechanical strength according to the present invention will be described.

Various polypropylene homopolymers having the above characteristics may be polymerized using a Zeigler-Natta catalyst or a metallocene catalyst. In the case of a polymer prepared with a metallocene catalyst, the polydispersity index tends to be lower than that of a case using a Ziegler-Natta catalyst. When the polydispersity index is low, the raw material has high spinning uniformity, which may be advantageous for high-speed spinning. The catalyst used for polymerization of the polypropylene homopolymer presented in the present invention is not limited to a Ziegler-Natta catalyst or a metallocene catalyst, and catalysts satisfying the above conditions (1), (2) and the following physical properties can be used in the present invention.

Meanwhile, the polypropylene homopolymer may have a melt index of 13 to 70 g/10 min to satisfy the above conditions (1) and (2), preferably a melt index of 14 to 60 g/10 min, more preferably a melt index of 15 to 55 g/10 min. When the melt index of the polypropylene homopolymer is less than 13 g/10 min, as the length of the polymer chain is increased, spinnability may be significantly reduced according to the high viscosity, and when the melt index exceeds 70 g/10 min, as the length of the polymer chain is shortened, mechanical properties may be lowered.

In this case, the melt index may be measured under conditions of a load of 2160 g and a temperature of 230° C. according to ASTM D1238-13 (or ISO 1133).

In addition, the polypropylene homopolymer may have a melting temperature of 140° C. to 200° C., preferably a melting temperature of 145° C. to 180° C., more preferably a melting temperature of 150° C. to 165° C. but is not limited thereto.

Meanwhile, the polypropylene homopolymer may have a polydispersity index of 3.2 or less, preferably 3 or less, more preferably 1.5 to 2.5 to satisfy the above conditions (1) and (2). When the polypropylene homopolymer has a polydispersity index of more than 3.2, fiber breakage may occur or the uniformity of the prepared non-woven fabric may be lowered, so that mechanical properties may be lowered.

According to an embodiment of the present invention, the fibers may be formed to further include a feel-improving agent.

The feel-improving agent performs a function of improving the softness of the non-woven fabric, and any material that can be used to improve the softness of the non-woven fabric in the art may be used without limitation, preferably when one more selected from among of a slip agent and a fabric softener including one or more selected from the group consisting of propylene-ethylene copolymers and $C_4$-$C_{12}$ alpha-olefin copolymers are included, it may be further advantageous to achieve good softness and a weight reduction while simultaneously having good spinnability and mechanical strength.

Meanwhile, when a slip agent is used as the feel-improving agent, when melt-blended with a resin, the slip agent gradually permeates or migrates to the surface during or after cooling and thus improves the slippery feel of the fiber or non-woven surface according to the permanent lubricating effect by forming a uniform and invisible thin coating.

Meanwhile, the slip agent may be used without limitation as long as it is a slip agent commonly used in the art, but erucamide may be preferably used.

Meanwhile, when using a fabric softener including one or more selected from the group consisting of the propylene-ethylene copolymer and $C_4$-$C_{12}$ alpha-olefin copolymer as the feel-improving agent, the propylene-ethylene copolymer and $C_4$-$C_{12}$ of the alpha-olefin copolymer may each independently have a melt index of 550 g/10 min or less, and preferably a melt index of 550 g/10 min or less.

In this case, the propylene-ethylene copolymer may include an ethylene monomer and a propylene monomer in a molar ratio of 1:0.8 to 0.95, preferably 1:0.85 to 0.9.

Meanwhile, the feel-improving agent may be further included in an amount of 0.1 to 25 parts by weight, preferably 0.5 to 20 parts by weight, based on 100 parts by weight of the polypropylene homopolymer. When the feel-improving agent is less than 0.1 parts by weight based on 100 parts by weight of the polypropylene homopolymer, softness cannot be improved to a desired level, and when the feel-improving agent exceeds 25 parts by weight, mechanical properties may be lowered.

In the spunbond non-woven fabric manufacturing process in which the above-described polypropylene homopolymer is applied as the main raw material, when the speed of the air that drags the fibers after the melt extrusion process of the resin is increased to increase the degree of intra-fiber crystal orientation and increase the mechanical strength properties of the fiber itself, the proportion of the fibers oriented in the machine direction (MD direction) in the laminated non-woven fabric becomes higher as the movement speed of fibers in the spin belt direction in which the fibers are laminated and collected increases. When the orientation direction of the fibers laminated in the non-woven fabric increases in the MD direction, the mechanical properties in the MD direction increase, but the proportion of fibers oriented in the CD direction decreases, thereby lowering the physical properties in the CD direction.

Accordingly, the non-woven fabric with improved mechanical strength according to the present invention may further satisfy the following condition (3).

As condition (3), the tensile strength in MD direction per unit weight/tensile strength in CD direction per unit weight may be ≤4, and preferably, the tensile strength in MD direction per unit weight/tensile strength in CD direction per unit weight may be ≤3.8.

When the tensile strength in MD direction per unit weight/tensile strength in CD direction per unit weight exceeds 4, there may be a problem in that the spinnability is lowered and cannot be used stably in the sanitary material processing process.

In addition, the non-woven fabric may have a tensile strength in the MD direction per unit weight of 0.19 $kg_f$/5 cm/gsm or more, preferably, a tensile strength in the MD direction per unit weight of 0.2 $kg_f$/5 cm/gsm or more, more preferably tensile strength in MD direction per unit weight of 0.20 $kg_f$/5 cm/gsm to 0.35 $kg_f$/5 cm/gsm.

In addition, the non-woven fabric may have a tensile strength in the CD direction per unit weight of 0.05 $kg_f$/5 cm/gsm to 2.0 $kg_f$/5 cm/gsm, and preferably a tensile strength in the CD direction per unit weight of 0.07 to 2.0 $kg_f$/5 cm/gsm, and more preferably, the tensile strength in the CD direction per unit weight of 0.07 to 0.30 $kg_f$/5 cm/gsm.

According to an embodiment of the present invention, the non-woven fabric may have a basis weight of 8 to 50 g/m$^2$ and preferably, a basis weight of 10 to 30 g/m$^2$. As the basis weight of the non-woven fabric satisfies the above range, it is possible to exhibit excellent spinnability, excellent softness, and excellent tensile strength while enabling a weight reduction.

The non-woven fabric formed through the fibers formed including the polypropylene homopolymer according to the present invention may be manufactured through a spunbonding process. The mechanical strength of the non-woven fabric manufactured through the spunbonding process is determined by the combination of the mechanical strength of the fiber yarn itself controlled by the spunbond melt extrusion, cooling, and stretching processes, and mechanical strength generated by web-forming and thermocompression bonding (calendering) processes of the fiber yarn. Since the web-forming and thermocompression bonding processes are determined by the prepared spunbond equipment, the easiest way to change the physical properties of the non-woven fabric is to change the physical properties of the resin for the spunbond non-woven fabric or to change the melt extrusion, cooling, and stretching processes before web forming. However, there is a limit to improving the mechanical properties of the fiber yarn by changing the melt extrusion, cooling, and stretching processes without changing the physical properties of the resin for the non-woven fabric.

In general, the best way to improve the mechanical properties of fibers is to increase the crystallinity of the fibers and to increase the orientation of these crystallized polymers. In the spunbonding process, the crystallinity of polypropylene is mostly determined at the beginning of melt extrusion spinning. Therefore, in order to increase the degree of crystal orientation, the spinning speed of the fiber must be increased by increasing the moving speed of air that indirectly drags the fiber. However, each facility has a limit in increasing the spinning speed, and when the properties of the fibers to be spun are not uniform, some fibers are easily broken and defects such as yarn breakage easily occur. Therefore, in order to improve the mechanical properties of the non-woven fabric, the uniformity of the polymer resin for the spunbonding process and the spinning stability in high-speed spinning must be supported.

Accordingly, the present invention prepares a non-woven fabric through a polypropylene homopolymer satisfying the above-described physical properties.

Meanwhile, the present invention provides a sanitary material formed including the above-described non-woven fabric.

The non-woven fabric with improved mechanical strength according to the present invention exhibits excellent spinnability, excellent softness, and excellent tensile strength while enabling a weight reduction.

Hereinafter, the present invention will be described in more detail through examples, but the following examples do not limit the scope of the present invention, which should be construed to aid understanding of the present invention.

Example 1

A polypropylene homopolymer having a melt index of 15 g/10 min and a polydispersity index of 1.7 was continuously spun using a spunbond manufacturing facility (Reifenhauser, Germany), and then the calendaring process was performed under the conditions of a temperature of 158° C. and a pressure of 70 dN/cm to prepare a non-woven fabric.

At this time, the basis weight of the prepared non-woven fabric was 13 g/m$^2$.

Examples 2 to 12 and Comparative Examples 1 to 3

Non-woven fabrics were prepared in the same manner as in Example 1, except that the non-woven fabrics were prepared by changing the melt index and polydispersity index of the polypropylene homopolymer, and whether or not to include a feel improving agent as shown in Tables 1 to 3.

Experimental Example

The following physical properties were evaluated for the non-woven fabrics prepared in Examples and Comparative Examples, and are shown in Tables 1 to 3 below.

1. Tensile Strength Measurement

With respect to the non-woven fabrics prepared according to Examples and Comparative Examples, a test piece having a width of 5 cm and an interval of 10 cm was pulled at a tensile speed of 500 mm/min in accordance with KSK 0520 by means of a tensile strength tester (Instron) to measure tensile strength in the machine direction (MD) direction and the cross direction (CD) direction, respectively.

2. Spinnability Evaluation

With respect to the non-woven fabrics prepared according to Examples and Comparative Examples, spinnability was evaluated as follows: when there is no abnormality while continuously spinning for 30 minutes, ○ is indicated, and in the case in which the long fibers constituting the non-woven fabric were broken three or more times and in the case of poor uniformity of the appearance of the non-woven due to the problem of spinning uniformity, X is indicated.

3. Softness Evaluation

With respect to the non-woven fabrics prepared according to Examples and Comparative Examples, softness was evaluated by sensory evaluation. Softness is numbered from 1 to 5, and it is divided into five grades. The better the softness, the lower the number, and the worse the softness, the higher the number.

TABLE 1

| Classification | | Example 1 | Example 2 | Example 3 | Example 4 | Example 5 |
|---|---|---|---|---|---|---|
| Polypropylene Homopolymer | Melt Index (g/10 min, a) | 15 | 10 | 25 | 34 | 60 |
| | Polydispersity Index (Mn/Mw, b) | 1.7 | 2.0 | 2.2 | 2.2 | 2.8 |
| Feel-Improving Agent | Type | — | — | — | — | — |
| | Content (parts by weight) | — | — | — | — | — |
| Basis Weight ($g/m^2$) | | 13 | 13 | 13 | 20 | 30 |
| Condition (1), b/a | | 0.113 | 0.2 | 0.088 | 0.065 | 0.047 |
| Condition(2), $(a^{1/2} + b)^{1/2}$ | | 2.36 | 2.27 | 2.68 | 2.83 | 3.25 |
| MD Tensile Strength ($kg_f$/5 cm/gsm) | | 0.270 | 0.281 | 0.262 | 0.243 | 0.204 |
| CD Tensile Strength ($kg_f$/5 cm/gsm) | | 0.12 | 0.067 | 0.090 | 0.078 | 0.107 |
| Condition (3), MD/CD Tensile Strength Ratio | | 2.25 | 4.2 | 2.9 | 3.1 | 1.9 |
| Spinnability Evaluation | | ○ | X | ○ | ○ | ○ |
| Spinnability-related defects | | None | Spinning uniformity is poor | None | None | None |
| Softness Evaluation | | 2 | 4 | 2 | 2 | 2 |

TABLE 2

| Classification | | Example 6 | Example 7 | Example 8 | Example 9 | Example 10 |
|---|---|---|---|---|---|---|
| Polypropylene Homopolymer | Melt Index (g/10 min, a) | 80 | 60 | 15 | 12 | 25 |
| | Polydispersity Index (Mn/Mw, b) | 3.3 | 4.1 | | 3.4 | 2.2 |
| Feel-Improving Agent | Type | — | — | — | — | Propylene-Ethylene Copolymer |
| | Content (parts by weight) | — | — | — | — | 12 |
| Basis Weight ($g/m^2$) | | 30 | 30 | 13 | 13 | 13 |
| Condition (1), b/a | | 0.041 | 0.068 | 0.22 | 0.283 | 0.088 |
| Condition(2), $(a^{1/2} + b)^{1/2}$ | | 3.50 | 3.44 | 2.62 | 2.62 | 2.68 |
| MD Tensile Strength ($kg_f$/5 cm/gsm) | | 0.170 | 0.20 | 0.293 | 0.286 | 0.235 |
| CD Tensile Strength ($kg_f$/5 cm/gsm) | | 0.085 | 0.080 | 0.084 | 0.068 | 0.091 |
| Condition (3), MD/CD Tensile Strength Ratio | | 2.0 | 2.5 | 3.5 | 4.2 | 2.7 |
| Spinnability Evaluation | | X | X | ○ | X | ○ |
| Spinnability-related defects | | Yarn breakage occurred | Yarn breakage occurred | None | Yarn breakage occurred | None |
| Softness Evaluation | | 3 | 3 | 2 | 2 | 1 |

1) In Example 10, a propylene-ethylene copolymer containing an ethylene monomer and a propylene monomer in a molar ratio of 1:0.87 was used.

TABLE 3

| Classification | | Example 11 | Example 12 | Comparative Example 1 | Comparative Example 2 | Comparative Example 3 |
|---|---|---|---|---|---|---|
| Polypropylene Homopolymer | Melt Index (g/10 min, a) | 25 | 21 | 10 | 200 | 21 |
| | Polydispersity Index (Mn/Mw, b) | 2.2 | 2.5 | 3.4 | 2.8 | 3.0 |

TABLE 3-continued

| Classification | | Example 11 | Example 12 | Comparative Example 1 | Comparative Example 2 | Comparative Example 3 |
|---|---|---|---|---|---|---|
| Feel-Improving Agent | Type | Erucamide | — | — | — | — |
| | Content (parts by weight) | 1.0 | — | — | — | — |
| Basis Weight (g/m$^2$) | | 13 | 13 | 19 | 55 | 13 |
| Condition (1), b/a | | 0.088 | 0.12 | 0.34 | 0.014 | 0.14 |
| Condition(2), $(a^{1/2}+b)^{1/2}$ | | 2.68 | 2.66 | 2.56 | 4.12 | 2.75 |
| MD Tensile Strength (kg$_f$/5 cm/gsm) | | 0.239 | 0.298 | 0.294 | 0.142 | 0.218 |
| CD Tensile Strength (kg$_f$/5 cm/gsm) | | 0.100 | 0.125 | 0.0918 | 0.071 | 0.086 |
| Condition (3), MD/CD Tensile Strength Ratio | | 2.8 | 2.5 | 3.2 | 2.0 | 3.2 |
| Spinnability Evaluation | | ○ | ○ | X | X | ○ |
| Spinnability-related defects | | None | None | Yarn breakage occurred | Spinning uniformity is poor | None |
| Softness Evaluation | | 1 | 1 | 3 | 5 | 2 |

1) In Example 11, the slip agent erucamide was used

As can be seen from Tables 1 to 3, in Examples 1, 3 to 5, 8, 10 to 12, which satisfy all of the melt index and polydispersity index of the polypropylene homopolymer according to the present invention, and whether or not to include a feel-improving agent, it can be confirmed that the effects of exhibiting excellent spinnability, excellent softness, and excellent tensile strength while enabling a weight reduction can be simultaneously achieved, compared to Examples 2, 6, 7, 9 and Comparative Examples 1 to 3, in which any one of them was omitted In addition, in Comparative Example 3, it was confirmed that mechanical strength was poor as the uniformity of the non-woven fabric decreased.

Although one embodiment of the present invention has been described above, the spirit of the present invention is not limited to the embodiments presented herein, and those skilled in the art, having an understanding of the scope of the invention, will readily suggest other embodiments by addition, alteration, deletion, addition, etc., of components within the same spirit, which are also intended to fall within the spirit of this invention.

What is claimed is:

1. A non-woven fabric with improved mechanical strength, wherein the non-woven fabric is formed through a fiber formed by continuously spinning a mixture in which a polypropylene homopolymer; and a feel-improving agent which is comprised at 0.5 to 20 parts by weight based on 100 parts by weight of the polypropylene homopolymer are mixed, wherein the feel-improving agent comprises a fabric softener, wherein the fabric softener comprises one or more selected from the group consisting of propylene-ethylene copolymers and C4 to C12 alpha-olefin copolymers, wherein all of the following conditions (1) to (3) are satisfied, and wherein the polypropylene homopolymer has a melt index of 13 to 70 g/10 min and a polydispersity index of 1.5 to 2.5:

$$b/a \leq 0.3 \quad (1)$$

$$(a^{1/2}+b)^{1/2} \leq 3.6 \quad (2)$$

$$\text{MD direction tensile strength per unit weight/CD direction tensile strength per unit weight} \leq 3.8, \quad (3)$$

wherein a is the melt index (g/10 min) of the polypropylene homopolymer, and b is the polydispersity index (Mw/Mn, weight average molecular weight/number average molecular weight) of the polypropylene homopolymer.

2. The non-woven fabric of claim 1, which satisfies the following conditions (1) and (2):

$$b/a \leq 0.23 \quad (1)$$

$$(a^{1/2}+b)^{1/2} \leq 3.33 \quad (2)$$

3. The non-woven fabric of claim 1, wherein a tensile strength in MD direction per unit weight is 0.19 kg$_f$/5 cm/gsm or more.

4. The non-woven fabric of claim 1, wherein a tensile strength in CD direction per unit weight is 0.05 to 2.0 kg$_f$/5 cm/gsm.

5. The non-woven fabric of claim 1, wherein the propylene-ethylene copolymer and the $C_4$-$C_{12}$ alpha-olefin copolymer each independently have a melt index of 550 g/10 min or less.

6. The non-woven fabric of claim 1, wherein the propylene-ethylene copolymer comprises an ethylene monomer and a propylene monomer in a molar ratio of 1:0.8 to 0.95.

7. The non-woven fabric of claim 1, wherein the non-woven fabric has a basis weight of 8 to 50 g/m$^2$.

8. A sanitary material formed by comprising the non-woven fabric according to claim 1.

* * * * *